US006254413B1

(12) United States Patent
Yasui et al.

(10) Patent No.: US 6,254,413 B1
(45) Date of Patent: Jul. 3, 2001

(54) ELECTRICAL CONNECTOR FOR FLAT CIRCUITS

(75) Inventors: Tatsuo Yasui, Higashi-Rinkan; Yoshiyuki Mizuno, Sagamihara, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/394,205

(22) Filed: Sep. 10, 1999

(51) Int. Cl.[7] ..... H01R 13/15
(52) U.S. Cl. ..... 439/260; 439/495
(58) Field of Search ..... 439/260, 77, 67, 439/492, 495, 329, 341

(56) References Cited

U.S. PATENT DOCUMENTS 5,695,359 * 12/1997 Fujikura et al. ..... 439/495
5,695,360 * 12/1997 Seto et al. ..... 439/495
5,842,883 * 12/1998 Igarashi et al. ..... 439/495
5,906,498 * 5/1999 Nagafuji ..... 439/260
5,924,891 * 7/1999 Benjamin et al. ..... 439/495

* cited by examiner

*Primary Examiner*—Hien Vu
(74) *Attorney, Agent, or Firm*—Stephen Z. Weiss

(57) ABSTRACT

An electrical connector is provided for terminating a flat circuit. The connector includes a dielectric housing having an elongated slot for receiving the flat circuit. A plurality of terminals are mounted on the housing and are spaced laterally along the slot. The terminals have contact portions for engaging appropriate conductors of the flat circuit. An actuator is pivotally mounted on the housing for rotational movement between an open position allowing insertion of the flat circuit into the slot and an actuating position biasing the flat circuit against the contact portions of the terminals. Complementary interengaging oblique ramps are provided on the housing and the actuator. The oblique ramps are arranged to confront and abut each other when the actuator is in its open position to hold the actuator thereat.

8 Claims, 9 Drawing Sheets

ELECTRICAL CONNECTOR FOR FLAT CIRCUITS

FIELD OF THE INVENTION

This invention generally relates to the art of electrical connectors and, particularly, to a connector for terminating a flat circuit.

BACKGROUND OF THE INVENTION

A wide variety of electrical connectors have been designed for terminating flat circuits, such as flat flexible cables, flexible printed circuits or the like. A typical connector for flat circuits includes a dielectric housing molded of plastic material, for instance. The housing has an elongated slot for receiving an end of the flat circuit which has been stripped to expose generally parallel, laterally spaced conductors. A plurality of terminals are mounted in the housing and are spaced laterally along the slot for engaging the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the terminals.

One of the problems which has developed with flat circuit connectors of the character described above is that the connectors have become extremely miniaturized and difficult to manipulate and/or operate. The overall length of such a connector may not be greater than the width of an operator's finger nail. Consequently, attempts have been made to provide means for holding the actuator in its first or open position to allow insertion of the flat circuit into the connector.

For instance, FIG. 3 shows a fragmented view of a prior art connector housing 51 and an actuator 52 that is rotatable relative to the housing in the direction of arrow 53 from a first or open position shown in FIG. 3 to a second or terminating position (not shown). The actuator is held in its open position by an edge 52*a* of the actuator being captured by a vertical slot 54 in the housing. When the actuator is rotated to its terminating position, edge 52*a* of the actuator moves into a horizontal slot 55. This vertical-and horizontal slot arrangement becomes worn during use, losing the capability of holding the actuator in its open position. In addition, it requires considerable forces to move the actuator from vertical slot 54 to horizontal slot 55. If attempts are made to reduce the depths of the slots in order to reduce these forces, the actuator often moves out of its intended position due to vibrations or other extraneous forces.

The present invention is directed to solving one or more of the various problems discussed above.

SUMMARY OF THE INVENTION

An object, therefore, of the invention is to provide an electrical connector for a flat circuit and including improved means for holding an actuator of the connector in a predetermined position.

In the exemplary embodiment of the invention, the connector includes a dielectric housing having an elongated slot for receiving the flat circuit. A plurality of terminals are mounted on the housing and are spaced laterally along the slot. The terminals have contact portions for engaging appropriate conductors of the flat circuit. An actuator is pivotally mounted on the housing for rotational movement between an open position allowing insertion of the flat circuit into the slot and an actuating position biasing the flat circuit against the contact portions of the terminals. Complementary interengaging oblique ramps are provided on the housing and the actuator. The ramps are arranged to confront and abut each other when the actuator is in its open position to hold the actuator in the open position.

As disclosed herein, a groove is formed in one of the housing or actuator for receiving a flange on the other of the housing or actuator. The complementary interengaging oblique ramps are located in the groove and on the flange. In the preferred embodiment, the flange projects outwardly from an end of the actuator generally parallel to the elongated slot and into the groove which opens inwardly of the housing. Preferably, one of the flanges projects outwardly from each opposite end of the actuator and into a pair of grooves in the housing at opposite ends of the slot.

Another feature of the invention is the provision of biasing means for biasing the complementary interengaging oblique ramps into confronting abutting relationship. As disclosed herein, the biasing means is provided by a resiliently flexible wall of the housing on which one of the ramps is formed.

A further feature of the invention is the provision of complementary interengaging latch means between the actuator and the housing. The latch means is effective to hold the actuator in its actuating position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
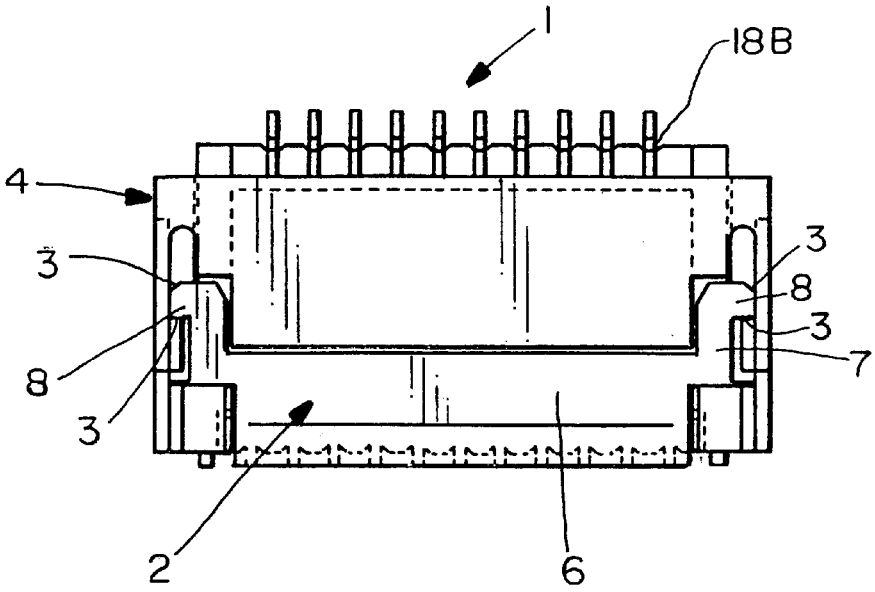
FIG. 1 is a top plan view of a flat circuit electrical connector according to the invention.
Figure 2:
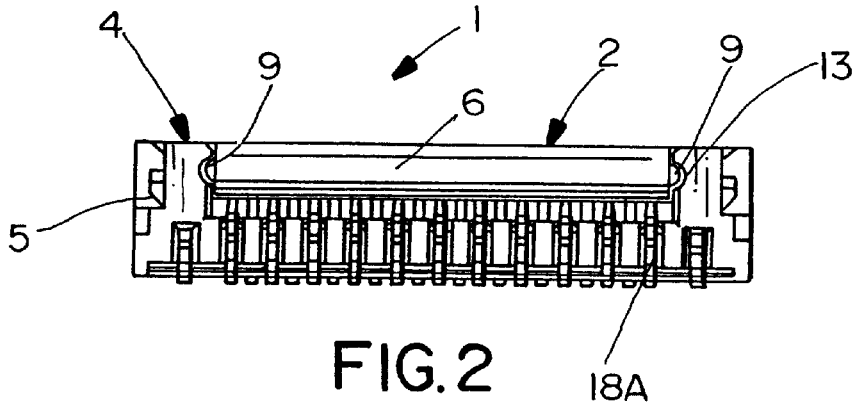
FIG. 2 is a front elevational view of the connector.
Figure 3:
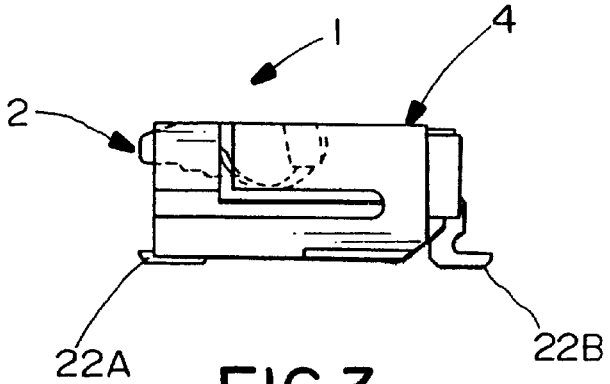
FIG. 3 is a side elevational view of the connector.

Referring to the drawings in greater detail, and first to FIGS. 1–8, the invention is embodied in an electrical connector, generally designated 1, for terminating a flat circuit (not shown). The flat circuit may be a flat flexible cable, a flexible printed circuit or the like. In any event, the flat circuit typically will have a plurality of generally parallel, laterally spaced conductors. The insulation of the circuit is removed at least along one side thereof and at an end thereof to expose portions of the conductors for terminating the circuit in connector 1.

Figure 4:
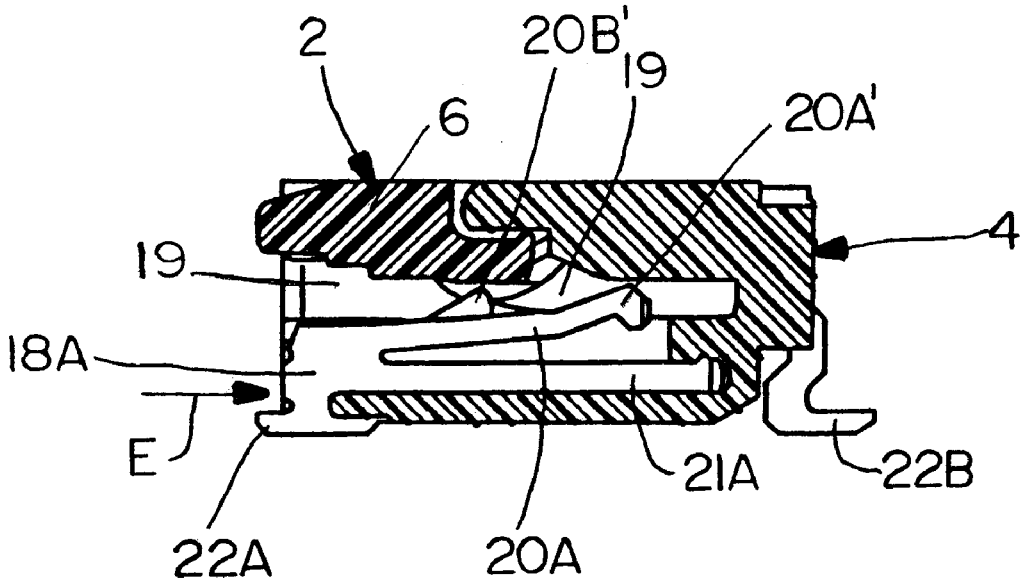
FIG. 4 is a front-to-rear section through the connector and showing one of the front-loaded terminals.
Figure 5:
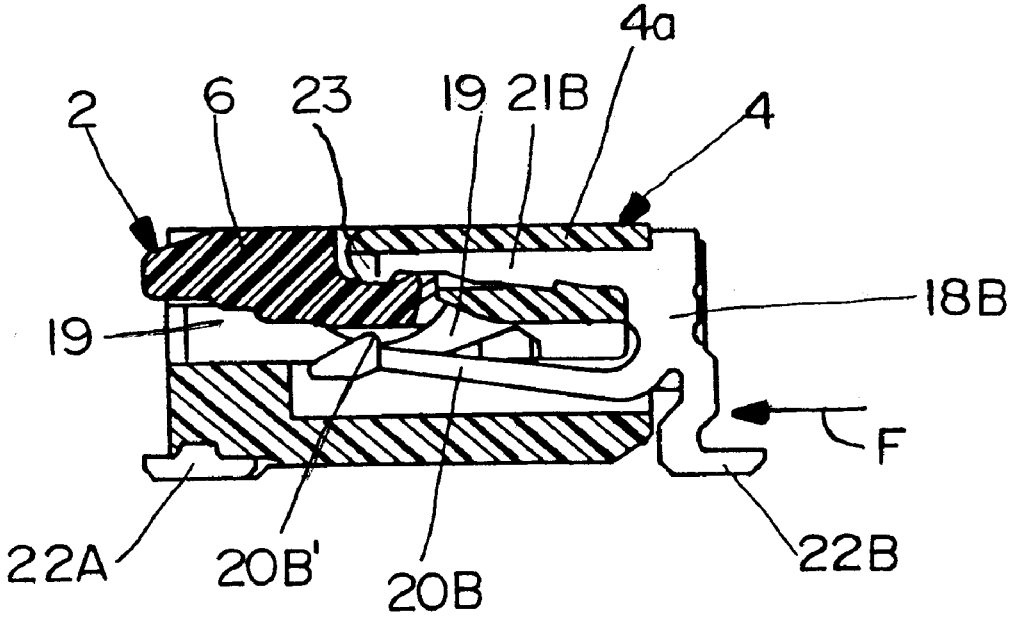
FIG. 5 is a view similar to that of FIG. 4, but showing one of the rear-loaded terminals.
Figure 6:
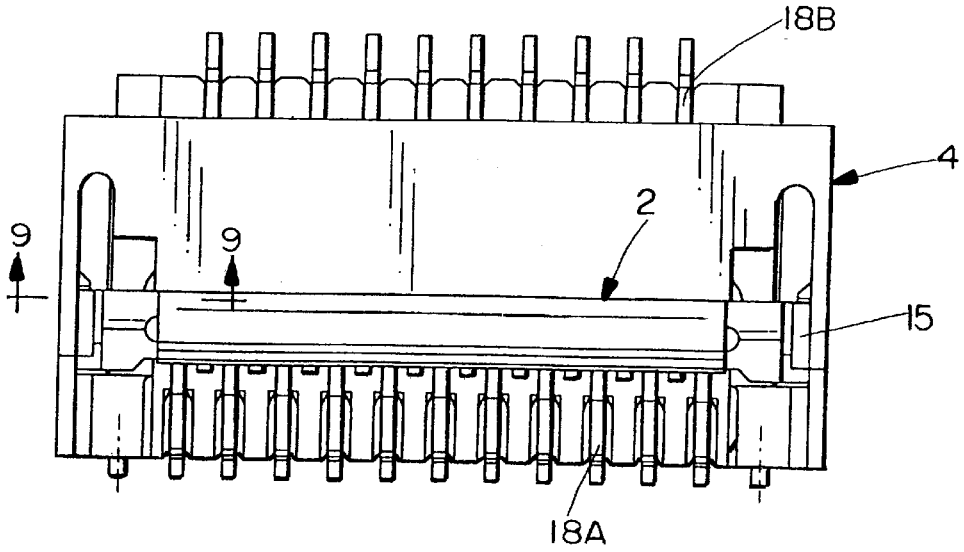
FIG. 6 is a top plan view of the connector, with the actuator in its open position.
Figure 7:
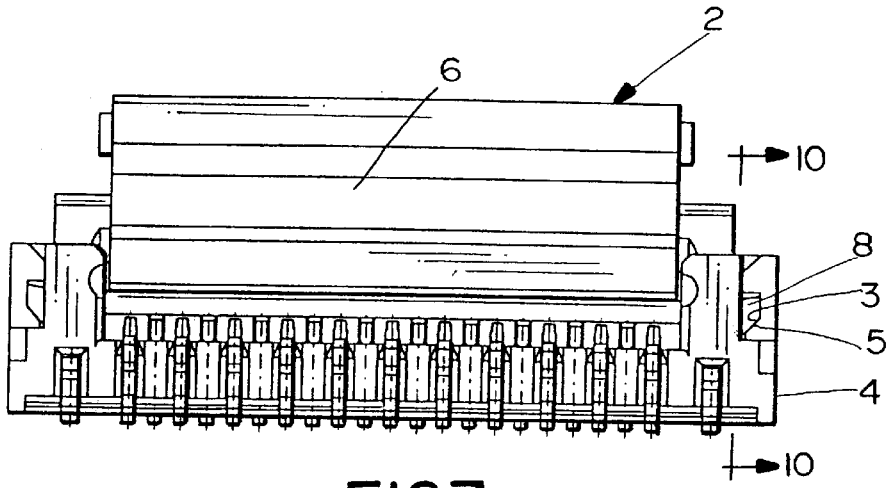
FIG. 7 is a front elevational view of the connector, with the actuator in its open position.
Figure 8:
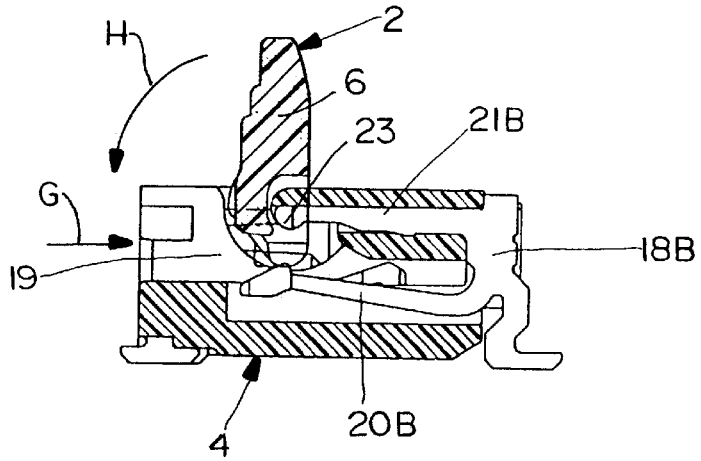
FIG. 8 is a sectional view similar to that of FIG. 5, with the actuator in its open position.

Electrical connector 1 includes an actuator, generally designated 2, which is pivotally mounted by means of a ramp arrangement to a dielectric housing, generally designated 4. The actuator is a one-piece structure and may be fabricated of various materials such as molded plastic. Housing 4 is a one-piece structure unitarily molded of dielectric material such as plastic or the like. As best seen in FIGS. 4, 5 and 8, the housing defines an elongated slot 19 for receiving the stripped end of the flat circuit.

Also as best seen in FIGS. 4, 5 and 8, a plurality of terminals 18A and 18B are mounted on dielectric housing 4. The terminals are stamped of conductive sheet metal material. Terminals 18A alternate with terminals 18B laterally along the length of circuit-receiving slot 19. As seen best in FIG. 4, terminals 18A are front-loaded terminals and are inserted into the housing in the direction of arrow "E". As seen best in FIG. 5, terminals 18B are rear-loaded terminals and are inserted into the housing in the direction of arrow "F". Terminal 18A has a contact arm 20A, a mounting post 21A and a solder tail 22A. Terminal 18B has a contact arm 20B, a mounting post 21B and a solder tail 22B. Contact arms 20A and 20B extend toward circuit-receiving slot 19 and terminate in contact portions 20A' and 20B' which are located in the slot. Mounting posts 21A and 21B mount terminals 18A and 18B, respectively, in housing 4. Solder tails 22A and 22B of terminals 18A and 18B, respectively, are soldered to appropriate circuit traces on a printed circuit board (not shown). Finally, mounting posts 21B of terminals 18B have rounded distal ends 23 as seen best in FIGS. 5 and 8 to facilitate pivoting actuator 2 thereabout between the open and terminating positions of the actuator described hereinafter.

Figure 9:
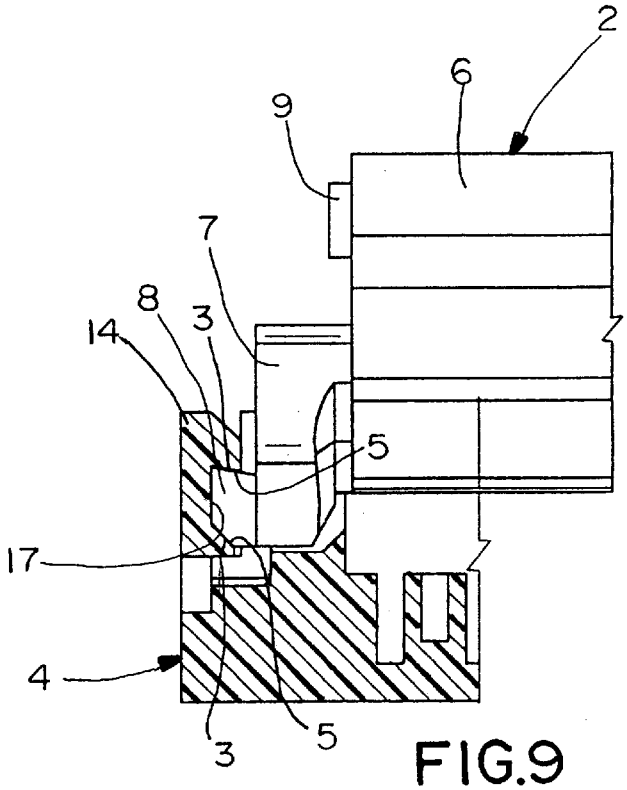
FIG. 9 is an enlarged vertical section taken generally along line 9—9 in FIG. 6.

More particularly, FIGS. 1–5 show actuator 2 in its closed or actuating position, and FIGS. 6–10 show the actuator in its open position. In the open position of the actuator, the stripped end of the flat circuit is freely insertable into slot 19 in the direction of arrow "G" (FIG. 8). The flat circuit is insertable with zero insertion forces (ZIF's), because actuator 2 completely clears slot 19. The actuator is closed in the direction of arrow "H" (FIG. 8) until the actuator reaches its terminating position as shown best in FIGS. 4 and 5. In the closed position, a center push plate 6 of the actuator biases the flat circuit against contact portions 20A' and 20B' of terminals 18A and 18B, respectively. The contact portions are spring loaded due to the flexibility of contact arms 20A and 20B which are formed as cantilevered components of the terminals. As best seen in FIG. 9, rounded latch projections 9 at opposite ends of center push plate 6 of the actuator snap into complementarily shaped recesses in housing 4 to latch and hold the actuator in its closed or terminating position.

FIGS. 11–17 show actuator 2 isolated from the remainder of the connector, and FIGS. 18–22 show housing 4 isolated from the remainder of the connector. Actuator 2 has cams 7 at opposite ends thereof, with the cams having rounded lower surfaces 7*a*. These cams ride within arcuate or semi-circular cam follower seats 11 in housing 4 as the actuator pivots between its open and terminating positions. The housing has abutment walls 12 at opposite ends thereof, and the abutment walls have semi-circular recesses 13 as seen best in FIG. 19 for receiving latch projections 9 of the actuator. When the actuator moves between its open and closed positions, a rear guiding projection 6*a* (FIG. 17) of center push plate 6 rides around rounded distal ends 23 (FIGS. 5 and 8) of mounting posts 21B of terminals 18B as described above.

Figure 10:
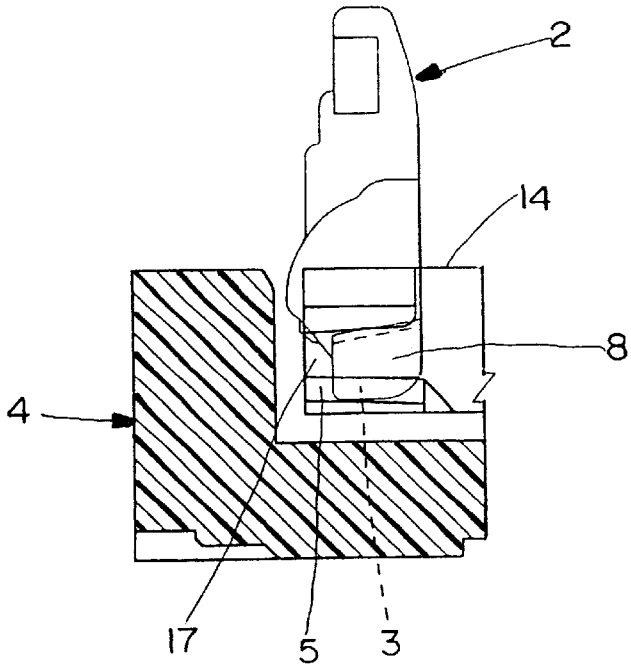
FIG. 10 is a vertical section taken generally along line 10—10 of FIG. 7.
Figure 11:
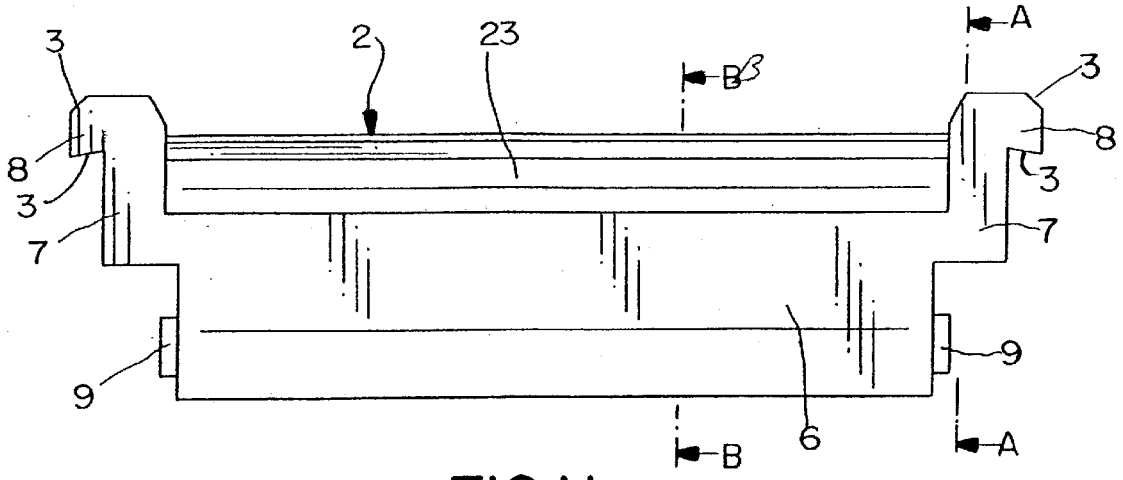
FIG. 11 is a top plan view of the actuator of the connector.
Figure 12:
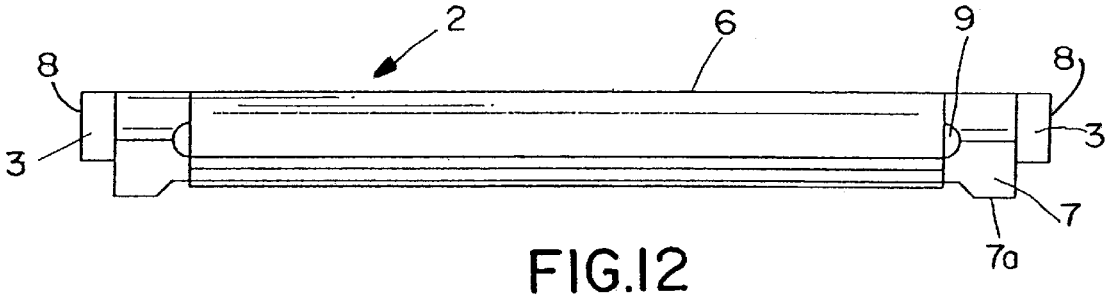
FIG. 12 is a front elevational view of the actuator.
Figure 13:
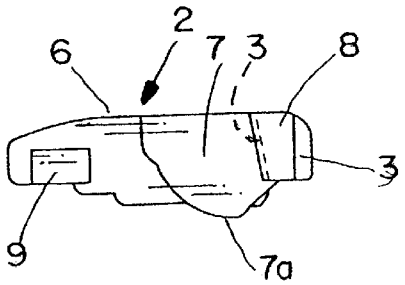
FIG. 13 is a side elevational view of the actuator.
Figure 14:
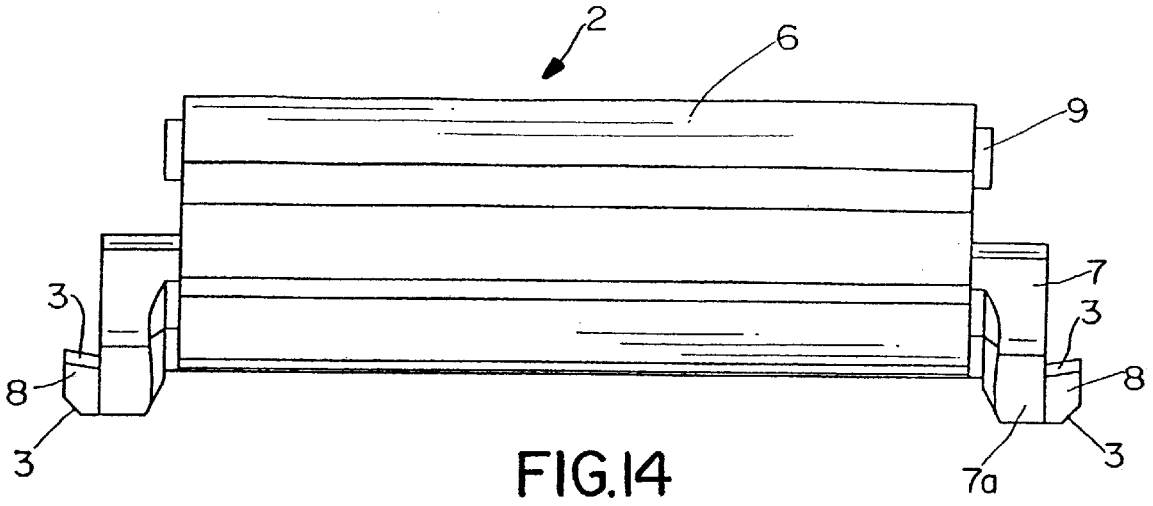
FIG. 14 is a bottom plan view of the actuator.
Figure 15:
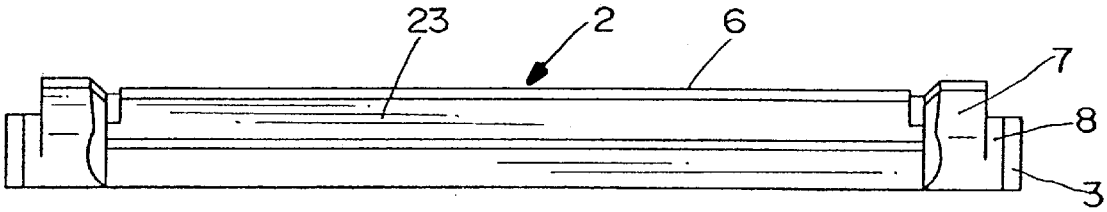
FIG. 15 is a rear elevational view of the actuator.
Figure 16:
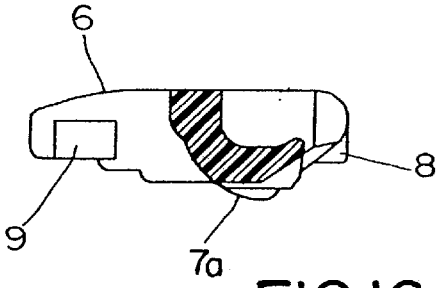
FIG. 16 is a section taken generally along line A—A in FIG. 11.
Figure 17:
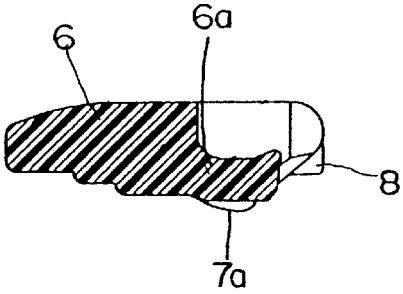
FIG. 17 is a section taken generally along line B—B in FIG. 11.
Figure 19:
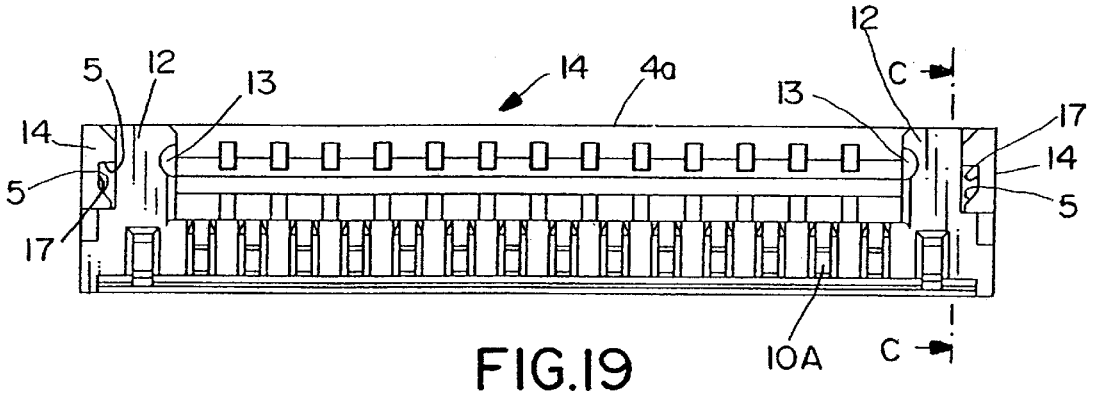
FIG. 19 is a front elevational view of the housing.
Figure 21:
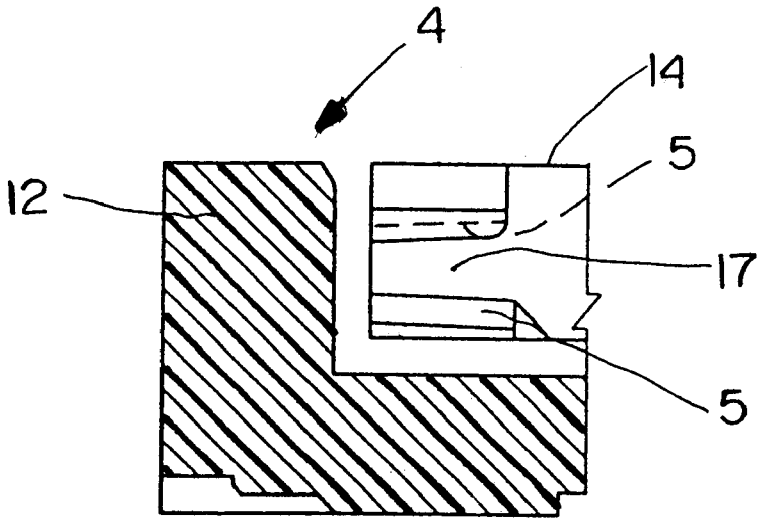
FIG. 21 is a section taken generally along line C—C in FIG. 19.
Figure 22:
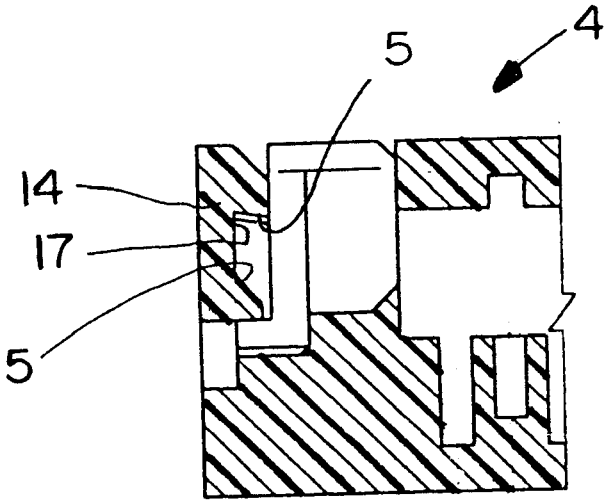
FIG. 22 is a section taken generally along line D—D in FIG. 18.
Figure 23:
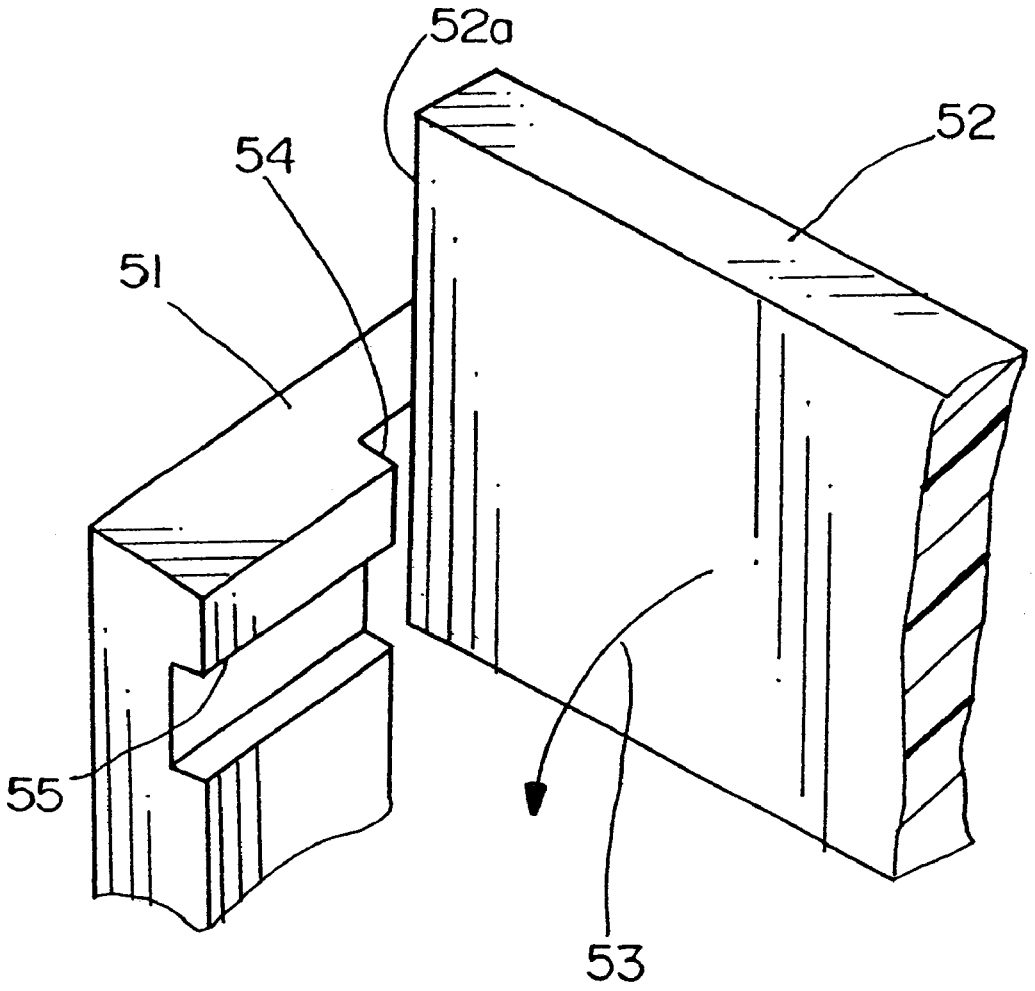
FIG.23 (PRIOR ART)
FIG. 23 is a fragmented section of the prior art as described in the "Background", above.

Generally, a ramp arrangement is provided for holding actuator 2 in its open position as seen in FIGS. 9 and 10. More particularly, FIGS. 11 and 14 best show that actuator 2 includes a flange 8 projecting outwardly from each cam 7 at each opposite end of the actuator. In other words, flanges 8 project outwardly generally parallel to elongated circuit-receiving slot 19 of the connector. The flange has oblique ramps 3 along opposite sides thereof. As best seen in FIGS. 19, 21 and 22, housing 4 includes a pair of end walls 14 having grooves 17 on the inside thereof The grooves are provided with oblique ramps 5 in the top and bottom of each groove. Now, turning to FIGS. 9 and 10, one of the flanges 8 of actuator 2 is shown in its complementary groove 17 in wall 14 of housing 4. It can be seen that oblique ramps 3 on the top and bottom of flange 8 confront and abut oblique ramps 5 in the top and bottom of groove 17. The "meshing" of complementary interengaging oblique ramps 3 and 5 are effective to hold actuator 2 in its open position.

Figure 18:
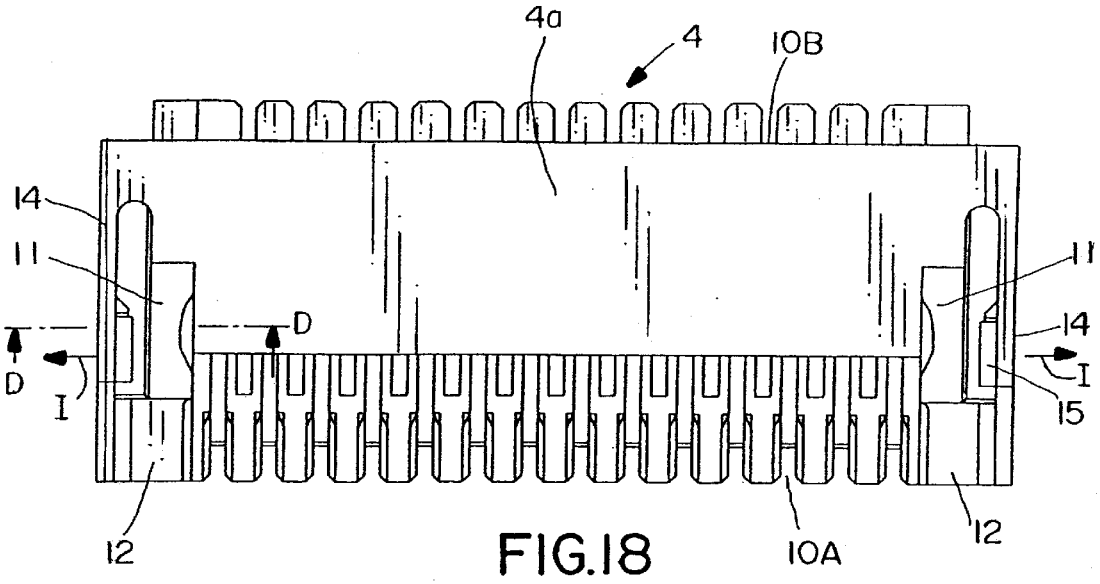
FIG. 18 is a top plan view of the housing of the connector.
Figure 20:
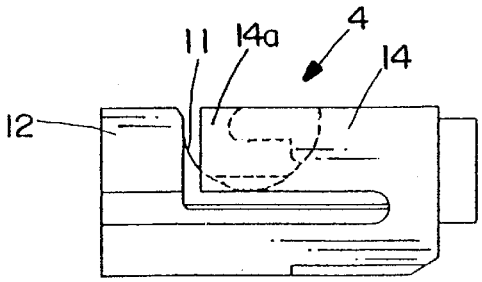
FIG. 20 is a side elevational view of the housing.

Finally, as best seen in FIGS. 18 and 20, each wall 14 of housing 4 is cantilevered to form a free end 14*a* (FIG. 20). Therefore, the resilient walls provide a biasing means for biasing complementary interengaging oblique ramps 3 and 5 into confronting abutting relationship. The flexible walls also allow actuator 4 to be moved between its open and terminating positions without excessive wear on the oblique ramps and the other surfaces of flanges 8 and grooves 17. In essence, when the actuator is pivoted, walls 14 can flex outwardly in the direction of arrows "I" (FIG. 18).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for a flat circuit comprising:

a dielectric housing having an elongated slot for receiving the flat circuit;

a plurality of terminals mounted on the housing and spaced laterally along the slot with contact portions for engaging appropriate conductors of the flat circuit;

an actuator pivotally mounted on the housing for rotational movement about a pivot axis between an open position allowing insertion of the flat circuit into the slot and an actuating position biasing the flat circuit against the contact portions of the terminals;

complementary interengaging oblique ramps on the housing and the actuator arranged to confront and abut each other when the actuator is in its open position to hold the actuator thereat, at least one of the ramps being formed on a resiliently flexible wall of the housing and biasing means for biasing the complementary interengaging oblique ramps into confronting abutting relationship.

2. The electrical connector of claim 1, including a groove in the housing for receiving a flange on the actuator, with said complementary interengaging oblique ramps being located in the groove and on the flange.

3. The electrical connector of claim 2 wherein said flange projects outwardly from an end of the actuator generally parallel to the elongated slot and into an inwardly opening groove in the housing.

4. The electrical connector of claim 3, including a pair of flanges projecting outwardly from opposite ends of the actuator and into a pair of grooves in the housing at opposite ends of the slot.

5. The electrical connector of claim 1, including complementary interengaging latch means between the actuator and the housing to latch the actuator in its actuating position.

6. An electrical connector for a flat circuit, comprising:

a dielectric housing having an elongated slot for receiving the flat circuit;

a plurality of terminals mounted on the housing and spaced laterally along the slot with contact portions for engaging appropriate conductors of the flat circuit;

an actuator pivotally mounted on the housing for rotational movement about a pivot axis between an open position allowing insertion of the flat circuit into the slot and an actuating position biasing the flat circuit against the contact portions of the terminals;

said actuator having a flange projecting outwardly from at least one end thereof generally parallel to the elongated slot;

said housing having a flexible wall with an inwardly opening groove for receiving said flange; and complementary interengaging oblique ramps on the flange of the actuator and in the groove of the housing, the ramps being arranged to confront and abut each other at an angle to said pivot axis when the actuator is in said open position to hold the actuator thereat, and with said wall flexing when the actuator is moved to said actuating position and the flange moves out of the groove.

7. The electrical connector of claim 6, including complementary interengaging latch means between the actuator and the housing to latch the actuator in its actuating position.

8. The electrical connector of claim 6, including one of said flanges, one of said grooves and their complementary interengaging oblique ramps at each opposite end of the actuator and housing.

* * * * *